US005941599A

United States Patent [19]

Roberts

[11] Patent Number: 5,941,599

[45] Date of Patent: Aug. 24, 1999

[54] INFANT AND CHILD CHAIR

[76] Inventor: Sheri K. Roberts, 200 J. Brown Rd., Saline, La. 71070

[21] Appl. No.: 09/028,192

[22] Filed: Feb. 23, 1998

[51] Int. Cl.[6] ..... A47C 7/54

[52] U.S. Cl. ..... 297/115; 297/181; 297/DIG. 6; 297/411.35; 5/655

[58] Field of Search ..... 297/181, 411.28, 297/411.27, 115, DIG. 6, 411.35, 411.24, 411.25, 411.44, 411.3, 256.16; 5/655, 922

[56] References Cited

U.S. PATENT DOCUMENTS

| | | | |
|---|---|---|---|
| D. 294,099 | 2/1988 | Bromberg . | |
| 3,269,621 | 8/1966 | Dishart | 5/655 X |
| 3,840,916 | 10/1974 | Jennings | 297/181 X |
| 4,428,514 | 1/1984 | Elf . | |
| 4,538,310 | 9/1985 | Scott | 5/655 |
| 4,607,403 | 8/1986 | Alivizatos | 5/655 |
| 4,695,092 | 9/1987 | Hittic . | |
| 4,702,523 | 10/1987 | Schrader . | |
| 4,862,535 | 9/1989 | Roberts | 5/655 |
| 4,909,573 | 3/1990 | Barry . | |
| 4,910,818 | 3/1990 | Grabill et al. | 5/922 X |
| 4,938,534 | 7/1990 | Tornero | 297/115 X |
| 5,112,104 | 5/1992 | De Giacomi | 297/181 X |
| 5,114,212 | 5/1992 | Verney et al. | 297/115 X |
| 5,137,335 | 8/1992 | Marten . | |
| 5,147,109 | 9/1992 | Jolly | 297/181 X |
| 5,175,899 | 1/1993 | Lou | 5/922 X |
| 5,448,790 | 9/1995 | Saro et al. | 5/922 X |
| 5,507,551 | 4/1996 | Barry . | |
| 5,551,749 | 9/1996 | Reher . | |
| 5,642,917 | 7/1997 | Geiger | 297/DIG. 7 X |

*Primary Examiner*—Peter M. Cuomo
*Assistant Examiner*—David E. Allred
*Attorney, Agent, or Firm*—John M. Harrison

[57] ABSTRACT

An infant and child chair which includes a body typically shaped in the configuration of an animal or character having a head which acts as a pillow and typically seated on a weighted base. The body may incorporate an infant pouch seat and a storage compartment for toys and books. The infant and child chair of this invention further includes a body frame for supporting bendable appendages or arms, as well as legs, that may be shaped and positioned to embrace an infant or child sitting in the chair, or to define arm rests. The chair body is typically filled with a particulate material such as STYROFOAM (polystyrene) beads or like pellets to facilitate conformity to a seated child.

15 Claims, 2 Drawing Sheets

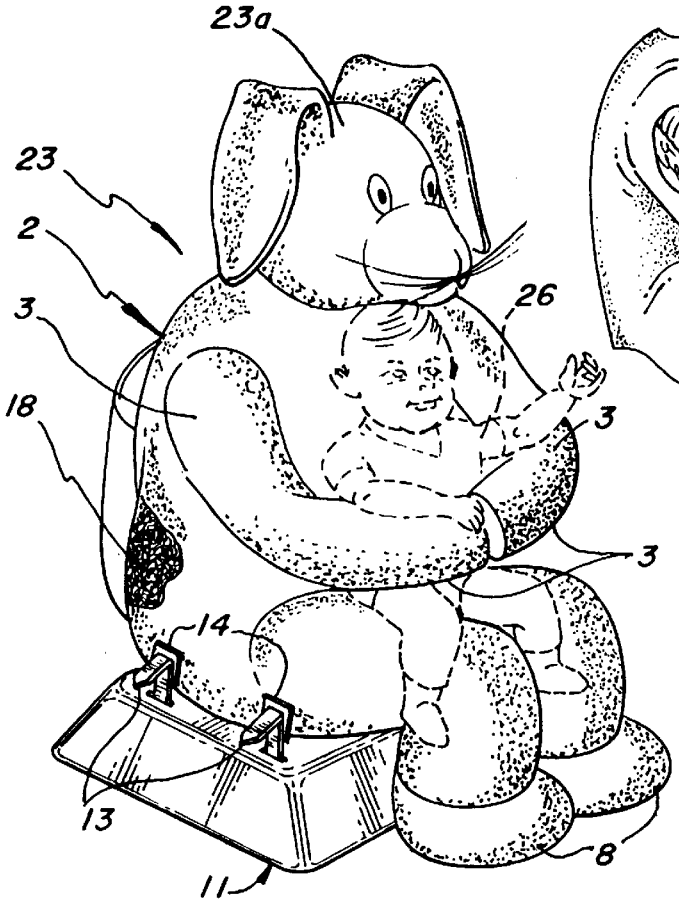
FIG. 6
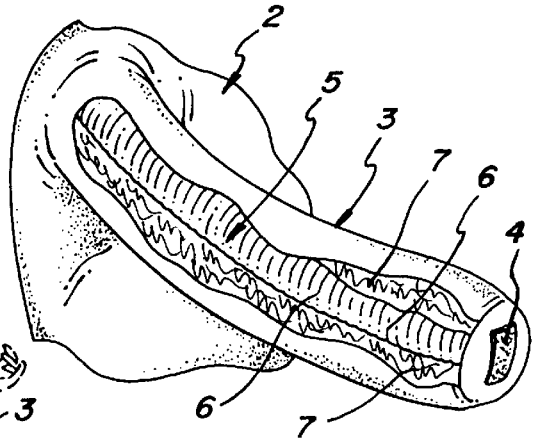
FIG. 8
FIG. 7
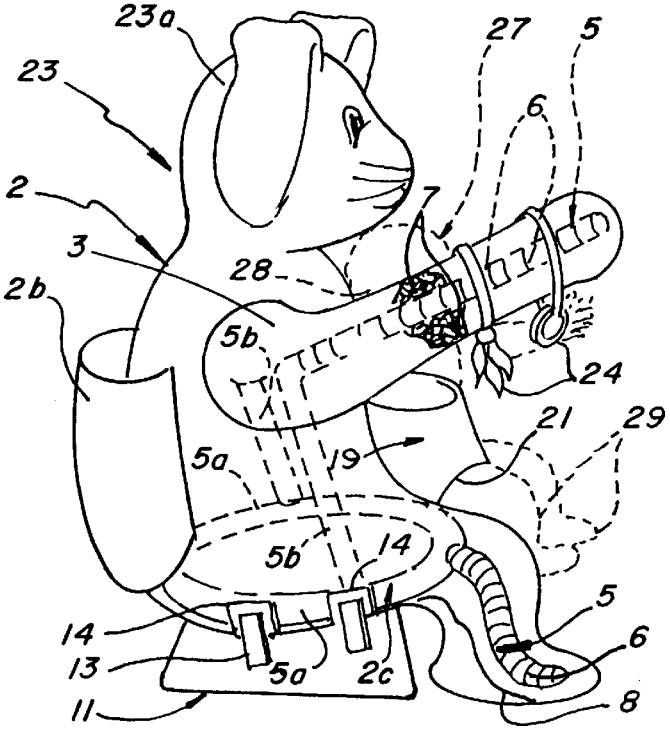
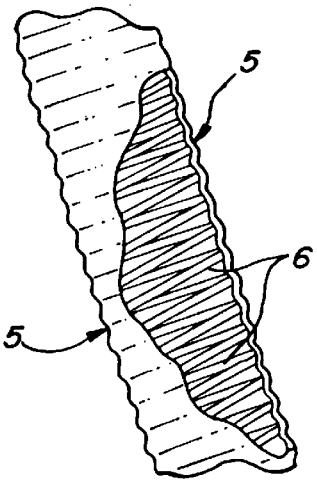
FIG. 9

INFANT AND CHILD CHAIR

BACKGROUND OF THE INVENTION

Field of the Invention

This invention relates to chairs for children and infants and more particularly, to a flexible, resilient infant and child chair which is typically constructed of a flexible, resilient material such as polyester, cotton or the like and filled with STYROFOAM (polystyrene), beads, or like particulate matter or pellets which assumes the shape of the infant or child sitting in the chair. The infant or child chair of this invention may be of any desired size and shape and may be crafted in the likeness of an animal such as a bear, rabbit or the like or another character, as desired. Appendages such as arms and legs extend from the chair body and may be bendable for engaging a child in a hugging configuration or deployment as arm rests. A toy and book storage pouch or compartment may also be provided in the child chair.

One of the aspects of infant and child care is the provision of furniture, including tables and chairs, for seating the children and infants. Various types of chairs for this use are well known in the art. J. C. Penney catalog, 1998 ed., page 642, details "Cuddle Pal Chairs", which are defined as acrylic, plush exterior urethane foam cushions with hug-around arms for a secure feeling. The chairs are designed to receive infants and children in a comfortable seating format. U.S. Design Pat. No. 294,099, dated Feb. 9, 1988, to Nancy J. Bromberg, details a child's car seat cover which includes a flexible, resilient cover resembling a cat for mounting on a car seat and receiving a child. U.S. Pat. No. 4,428,514, dated Jan. 31, 1984, to J. L. Elf, details an "Infant Carrier" which includes a pouch-like device having straps for fitting over a parents' shoulder and carrying an infant. U.S. Pat. No. 4,702,523, dated Oct. 27, 1987, to J. R. Schrader et al, details a "Harness For Restraining A Child". The harness device includes a pouch-like element having leg openings for receiving an infant and a strap designed to fit over the top of a chair and around the side of a chair to support the pouch in a chair. U.S. Pat. No. 4,695,092, dated Sep. 22, 1987, to D. A. Hittie, details a "Padded Infant Seat Liner". The padded liner is designed primarily for use beneath an infant seated in a safety automobile seat and is shaped generally in the configuration of an animal. U.S. Pat. No. 4,909,573, dated Mar. 20, 1990, to Barry, et al, details a "Child's Chair" which is shaped to define a desired cushioned character and has a metal frame within the character to allow the character to sit upright and receive the child in seated configuration. An anchor member is attached to the character for causing the character to remain in an upright, seated position. U.S. Pat. No. 5,137,335, dated Aug. 11, 1992, to T. J. Marten, details a "Support Apparatus Operable To Support A Child or the Like". The apparatus includes a base member which is secured in a substantially fixed position on a supporting object and having a surface deployed upwardly for engaging a child in a seated position. A seat belt is operable to maintain the child in position against the character. U.S. Pat. No. 5, 507,551, dated Apr. 16, 1996, to Timothy B. Barry, details a "Stuffed FIG. Chair" which includes a cushioned figure, a removable seat and a mechanism for removably fastening the removable seat to the cushioned figure. The cushioned figure includes a torso connected to a pair of lower limbs with arms extending outwardly above the lower limbs. U.S. Pat. No. 5,551,749, dated Sep. 3, 1996, to Judy M. Reher, et al, details a "Child Support Cushion" having an inner support structure, including a backrest and seat and base support member and having a removable cushion assembly. The cushion assembly has a back cushion section, a seat cushion section, a pair of side support sections and an outer cover is attached to the cushion assembly.

It is an object of this invention to provide an infant and child chair which is constructed of a flexible, resilient material containing stuffing or particulate matter such as STYROFOAM (polystyrene) beads or like pellets to facilitate conforming to the shape and form of the infant or child seated in the chair, and further including bendable arms and/or legs that may be adjusted to define chair arms and to embrace the seated infant or child.

Another object of this invention is to provide an infant and child chair which is typically characterized by a simulated animal or character and includes a body having a typically polyester, cotton, nylon or alternative covering enclosing typically stuffing or particulate material such as STYROFOAM (polystyrene) beads, or similar pellets or the like, which will readily conform to the shape of the infant or child seated therein. The chair further includes a flexible, resilient head, a frame located in the body and bendable arms containing a flexible spring attached to the frame and having a "memory", and an infant pouch seat for receiving an infant, to facilitate bending the arms around the infant or child seated in the chair or manipulating the arms in a downward configuration to serve as armrests for the seated child.

Yet another object of this invention is to provide a new "bean bag" type chair for infants and children, which chair is characterized by a flexible, resilient covering containing multiple particulate matter such as STYROFOAM (polystyrene) beads, particulate matter or the like to define a chair body, a frame provided in the chair body, flexible arms having a bendable spring mounted on the frame and having a "memory", which arms may be shaped to embrace the child or infant or to extend downwardly and serve as armrests, optional loop-pile fasteners provided on the arms and body portion of the chair for stabilizing the arms in selected positions, an infant pouch seat provided on or in the chair for receiving and supporting an infant and facilitating wrapping of the arms around the infant in a hugging configuration and an optional toy and book storage compartment provided on the back and/or sides of the chair body.

Another object of the invention is to provide a child and infant chair having a flexible, resilient animal or character head and body and bendable arms and/or legs, as well as a pouch or seat element for receiving and supporting the infant, such that the arms and/or legs can be manipulated into a "hugging" configuration around the child or infant.

SUMMARY OF THE INVENTION

These and other objects of the invention are provided in a new and improved infant and child chair having a body typically constructed of polyester, nylon or alternative material and typically filled with particulate matters such as STYROFOAM (polystyrene) beads, or like pellets for conforming to the shape of the infant or child seated in the chair, a head which typically simulates an animal or character, a frame positioned inside the chair body, a fixed or pivoting base which may be strapped or fixed to the chair body frame and bendable springs or like members located in arms extending from the body and attached to the frame. The arms are typically provided with one element of a loop-pile fastener on the ends thereof for bending the arms into "hugging" configuration around a child or infant seated in the chair and downwardly to corresponding elements of the loop-pile fastener located on legs extending from the chair body or on the body of the chair, to act as armrests and an infant pouch seat provided in the chair between the arms for receiving an infant. In a preferred embodiment the chair may also include a toy or book pouch or compartment for storage of toys, books and other items.

BRIEF DESCRIPTION OF THE DRAWINGS

The invention will be better understood by reference to the accompanying drawings, wherein:

FIG. 6 is a perspective view of a rabbit chair embodiment of the infant and child chair of this invention;

FIG. 7 is a side view of the rabbit chair illustrated in FIG. 6, more particularly illustrating an internal frame which supports arm and leg springs and an optional storage pouch or compartment provided on the back of the rabbit chair;

FIG. 8 is a side view, partially in section, of a typical arm and body portion of the bear chair illustrated in FIGS. 1 and 2 and the rabbit chair illustrated in FIGS. 6 and 7, more particularly illustrating a preferred arm positioning spring located inside each of the arms of the bear chair and rabbit chair to facilitate bendable movement of the arms and creating a "memory" bend in the arms; and FIG. 9 is an enlarged view, partially in section, of the arm positioning spring illustrated in FIG. 8, more particularly illustrating typical spring coils.

DESCRIPTION OF THE PREFERRED EMBODIMENTS

Figure 1:
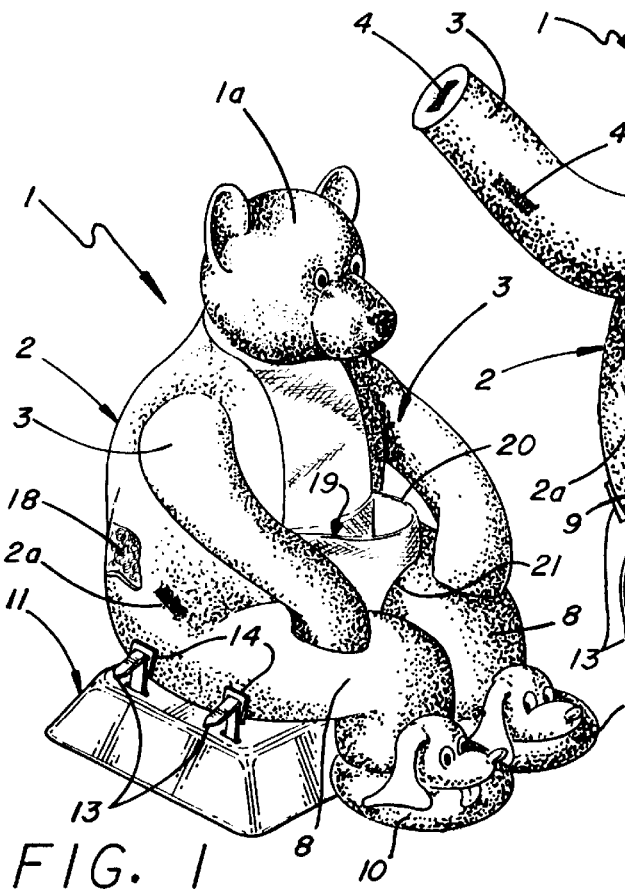
FIG. 1 is a perspective view of a bear chair embodiment of the infant and child chair of this invention.
Figure 2:
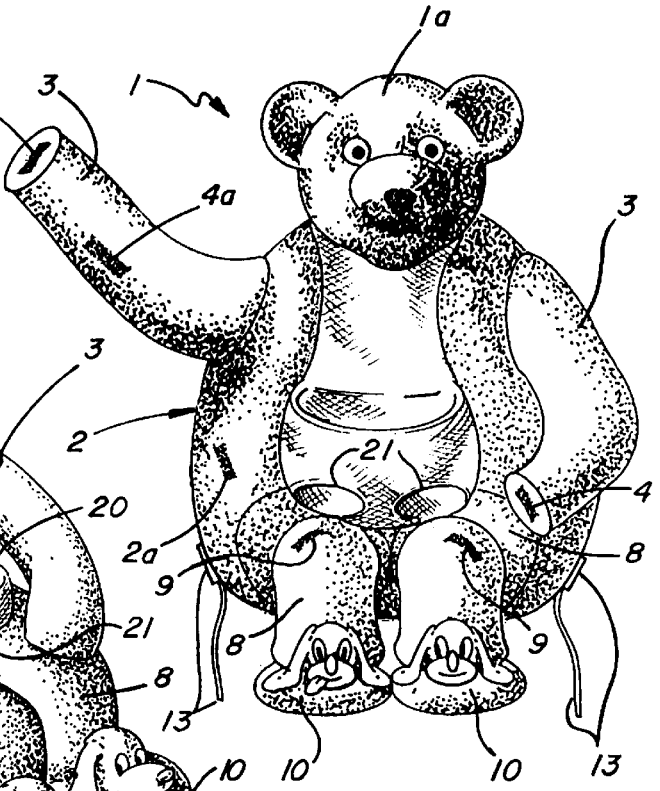
FIG. 2 is a front view of the bear chair illustrated in FIG. 1, with one of the arms in extended configuration.

Referring initially to FIGS. 1–3, 8 and 9 of the drawings, in a first preferred embodiment of the invention the infant and child chair is configured as a bear chair generally illustrated by reference numeral 1 and having a flexible, resilient bear head 1*a* that simulates a bear and typically acts as a pillow for a child seated in the bear chair 1. The bear head 1*a* is mounted on a body 2, typically constructed of polyester, cotton, nylon or other flexible, resilient material and provided with a suitable interior stuffing or with pelletized or particulate material such as STYROFOAM (polystyrene) beads or like pelletized or particulate material 18. Accordingly, in a preferred embodiment of the invention the body 2 is characterized as a "bean bag"-type construction which will accommodate an infant or a child, as hereinafter described. Appendages such as arms 3 and legs 8 typically project from the body 2 of the bear chair 1 and the arms 3 are typically provided with an arm pile element 4 at the extending ends thereof and an elbow pile element 4*a* at approximately the elbow location, as illustrated in FIG. 2, for purposes which will be hereinafter further described. As illustrated in FIGS. 8 and 9, in another preferred embodiment of the invention each of the arms 3 includes a positioning spring 5, defined by multiple spring coils 6, surrounded by arm stuffing or padding 7, which may typically be non-flammable or treated polyester or other suitable material known to those skilled in the art. The positioning springs 5 in the arms 3 are designed to mount on a body frame 2*c,* illustrated in FIG. 7, and facilitate manipulation and straightening or bending of the arms 3 in any desired configuration in a "memory" bend or position that allows the arms 3 to maintain the configured position until that position is manually changed by a user, as hereinafter further described. Accordingly, referring again to FIG. 1 of the drawings, the arms 3 may be manipulated into a position such that they define one or more armrests on the bear chair 1. Alternatively, as illustrated in FIG. 2, one of the arms 3 may be manipulated downwardly as illustrated with respect to the left arm 3 and the other extended outwardly, as illustrated with respect to the right arm 3 and the arms 3 will maintain the desired positions because of the "memory" in the positioning springs 5. Similarly, it will by appreciated by those skilled in the art that the legs 8 may also be provided with bendable members such as the positioning springs 5, illustrated in FIGS. 8 and 9, for bending adjustment with a "memory", like the arms 3, as further hereinafter described.

Referring again to FIGS. 1 and 2 of the drawings, the legs 8 typically extend from the lower portion of the body 2 of the bear chair 1 and may be fitted with decorative shoes 10, as illustrated. Leg loop elements 9 may also be sewn or otherwise attached to the legs 8 at approximately the knee area in order to receive the respective arm pile elements 4 and facilitate manipulation of the arms 3 into the armrest configuration illustrated in FIG. 1. Furthermore, referring again to FIG. 2, one or both of the arms 3 may be positioned in the downward configuration approximately as illustrated by the left-hand arm 3, to attach the elbow pile element 4*a,* located on the arm or arms 3, to the corresponding body loop element 2*a,* attached to the body 2 and maintain one or both of the arms 3 securely in a downwardly-extending position adjacent to the body 2.

Figure 3:
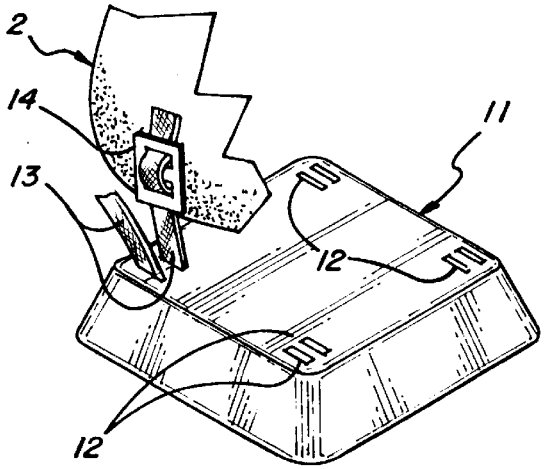
FIG. 3 is a perspective view of a first typical base for receiving the body portion of the bear chair illustrated in FIGS. 1 and 2.

Referring now to FIGS. 1 and 3 of the drawings, in another preferred embodiment of the invention the body 2 of the bear chair 1 is seated on a square base 11, typically fitted with base slots 12 for receiving straps 13 and engaging the buckles 14, which may be sewn or otherwise attached to the lower portion of the body 2 of the bear chair 1. Accordingly, the straps 13 can be extended through the sets of parallel, spaced-apart base slots 12 and into the respective buckles 14 to removably secure the body 2 of the bear chair 1 to the square base 11. Furthermore, it will be appreciated by those skilled in the art that the square base 11 may contain a metal weight or, in the alternative, sand, water or other heavy material for maintaining the bear chair 1 in an upright, stable configuration as illustrated in FIG. 1.

Figure 4:
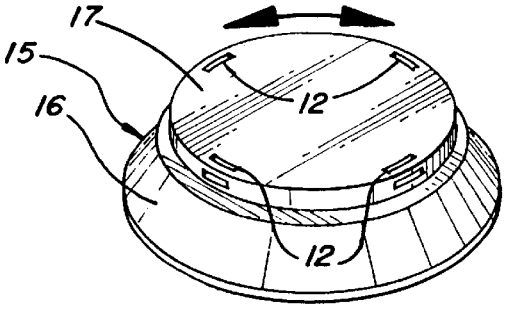
FIG. 4 is a perspective view of an alternative round, pivoting base for supporting the bear chair illustrated in FIGS. 1 and 2.
Figure 5:
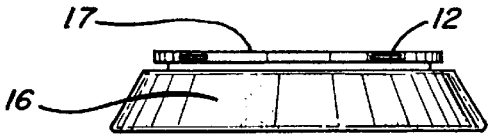
FIG. 5 is a side view of the pivoting round base illustrated in FIG. 4.

Referring to FIGS. 4 and 5 of the drawings, in an alternative embodiment of the invention a round base 15 may be provided to support the body 2 of the bear chair 1. The round base 15 typically includes a fixed element 16 for resting on the floor or other flat surface and a pivoting element 17, pivotally attached to the fixed elements 16 by any desired means known to those skilled in the art. The pivoting element 17 is typically fitted with sets of parallel base slots 12 in the same manner as the square base 11 illustrated in FIG. 3, to receive the straps 13 and facilitate attachment of the body 2 of the bear chair 1 to the pivoting element 17 of the round base 15. In this manner, the entire body 2 of the bear chair 1 is allowed to pivot in a 360-degree circle while an infant or child is seated in bear chair 1.

Referring again to FIGS. 1 and 2 of the drawings, in a most preferred embodiment of the invention an infant pouch seat 19 is attached to or formed in the body 2 of the bear chair 1 and extends downwardly to define a top opening 20 and a pair of leg openings 21 for receiving an infant in seated configuration in the bear chair 1, as hereinafter described. It will be appreciated by those skilled in the art that the infant pouch seat 19 can be shaped from any desired material which is sewn or otherwise attached to the body 2 to define the top opening 20 and leg openings 21. Alternatively, the top opening 20 and leg openings 21 can be shaped in a panel sewn to the body 2, as desired.

Referring now to FIGS. 6 and 7 of the drawings, in another preferred embodiment of the invention the infant and child chair of this invention is characterized by a rabbit chair 23 which simulates a rabbit and includes a flexible, resilient rabbit head 23*a,* attached to a body 2, which rabbit head 23*a* and body 2 are characterized in a preferred embodiment by essentially the same construction as the bear chair 1 illustrated in FIGS. 1 and 2 and described above. However, the body 2 of the rabbit chair 23 includes an internal body frame 2*c,* which includes a circular or elliptical, typically metal, spring mount ring 5*a,* having upward-standing arm supports 5*b,* also typically constructed of metal, that mount the respective positioning springs 5, illustrated in FIGS. 8 and 9. Additional positioning springs 5 may be attached to the spring mount ring 5*a* and extended into the legs 8 for selective adjustment of the legs 8 in the same manner as the arms 3. Accordingly, the respective arms 3 and optionally, the legs 8, of the rabbit chair 23 can be configured in any desired position, typically around the chest of a child 26, illustrated in phantom in FIG. 6, to simulate a "hugging" action by the rabbit chair 23. Furthermore, the body 2 of the rabbit chair 23 can be seated on a square base 11 as illustrated in FIGS. 6 and 7 and is typically attached to the square base 11 by means of straps 13 using the buckles 14, which may be mounted on the spring mount ring 5*a* and extended through the body 2. Alternatively, the body 2 can be secured to the pivoting element 17 of the round base 15, illustrated in FIGS. 4 and 5, as described above with respect to the bear chair 1, or using the spring mount ring 5*a*. In another preferred embodiment of the invention one or more arm trinkets 24 can be suspended from one or both of the arms 3 of the rabbit chair 23 as illustrated in FIG. 7, to serve as a "mobile" and attract the attention of the infant 27, located in an infant pouch seat 19, which is attached to or shaped in the body 2 of the rabbit chair 23 in the same manner as described above with respect to the bear chair 1 illustrated in FIGS. 1 and 2. Accordingly, the infant 27 may be snugly and comfortably seated in the infant pouch seat 19, with the infant body 28 projecting from the top opening 20 and the infant's legs 29 extending from the respective leg openings 21.

In still another preferred embodiment of the invention a storage pouch or compartment 2*b* can be provided at any desired location, typically on the back portion of the body 2 of the rabbit chair 23. The storage compartment 2*b* can typically be used to store toys, books and other items useful in the care, recreation and instruction of the child 26 or infant 27 and may also be provided on the body 2 of the bear chair 1 illustrated in FIGS. 1 and 2.

It will be appreciated by those skilled in the art that both the bear chair 1 and rabbit chair 23 embodiments of the infant and child chair of this invention are only illustrative of many various character and animal designs that may be utilized in the invention. Accordingly, it will is understood that the infant and child chair of this invention may be constructed in any desired size, of any desired character and of any desired material, including acrylic, polyester, nylon, cotton and the like, and may be provided with a zipper opening (not illustrated) or other fasteners for adding or removing the interior stuffing, padding, expanded foam beads or the like, as desired, when washing the exterior of the body 2. Furthermore, although the respective arms 3 of the bear chair 1 and the rabbit chair 23 are preferably constructed using a body frame 2*c* and positioning springs 5 as illustrated in FIGS. 7, 8 and 9, other bendable metal or plastic materials which have a "memory" when fashioned into a selected configuration may be utilized, according to the knowledge of those skilled in the art to effect the purposes of the invention. The arms 3 may also be provided without the legs 8 (as in the case of a simulated octopus) and the legs 8 without the arms 3, as desired. Accordingly, a primary feature of the invention is the provision of arms 3 (as well as legs 8 if desired) which will wrap around and embrace a child 26 or an infant 27, as illustrated in FIGS. 6 and 7 of the drawings. Another primary feature of the invention is the provision of arm trinkets 24 positioned on one or both arms 3 of the respective characters in the infant and child chair of this invention to act as a mobile in maintaining the attention of a child 26 or infant 27.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A chair for a child, comprising a flexible, resilient chair body, support means provided in said chair body for supporting said chair body and arms extending from said chair body, said arms each having a bendable member therein, said bendable member extending from said support means and having a "memory" for assuring a selected configuration of said arms, whereby when the child is resting against the chair body, said arms are selectively bendable around the child in a hugging configuration; legs extending from said chair body below said arms; and a first element of at least one loop-pile fastener attached to said arms and a second element of said loop-pile fastener attached to said legs, whereby said arms are selectively configured against said legs to define arm rests in said chair responsive to engagement of said first element and said second element, respectively, of said loop-pile fastener.

2. The chair of claim 1 comprising seat pouch means provided on said chair body for receiving and supporting the child.

3. The chair of claim 1 comprising a second element of a second loop-pile fastener attached to said chair body, whereby said arms are selectively configured against said chair body responsive to engagement of said first element of said at least one loop-pile fastener and said second element of said second loop-pile fastener, respectively.

4. The chair of claim 1 comprising a headrest provided on said chair body for serving as a pillow for the head of the child.

5. The chair of claim 4 comprising seat pouch means provided on said chair body for receiving and supporting the child.

6. The chair of claim 5 comprising pellet means provided in said chair body for defining the configuration of said chair body.

7. The chair of claim 1 comprising a toy and book storage compartment provided on said chair body for storing toys and books in said chair.

8. The chair of claim 7 comprising seat pouch means provided on said chair body for receiving and supporting the child.

9. The chair of claim 8 comprising pellet means provided in said chair body for defining the configuration of said chair body.

10. The chair of claim 9 comprising a headrest provided on said chair body for serving as a pillow for the head of the child.

11. The chair of claim 1 comprising base means attached to said chair body for supporting said chair body.

12.The chair of claim 11 comprising seat pouch means provided on said chair body for receiving and supporting the child.

13. The chair of claim 12 comprising pellet means provided in said chair body for defining the configuration of said chair body.

14. The chair of claim 13 comprising a headrest provided on said chair body for serving as a pillow for the head of the child.

15. The chair of claim 14 comprising a toy and book storage compartment provided on said chair body for storing toys and books in said chair.

* * * * *